US007765772B2

(12) United States Patent
DeLuca et al.

(10) Patent No.: US 7,765,772 B2
(45) Date of Patent: Aug. 3, 2010

(54) AUTOMATED CAPPING HEAD

(75) Inventors: John E. DeLuca, Woodstock, CT (US); Grzegorz Podstawka, Webster, MA (US)

(73) Assignee: Magnetic Technologies Ltd., Oxford, MA (US)

( * ) Notice: Subject to any disclaimer, the term of this patent is extended or adjusted under 35 U.S.C. 154(b) by 168 days.

(21) Appl. No.: 12/243,634

(22) Filed: Oct. 1, 2008

(65) Prior Publication Data

US 2010/0077700 A1 Apr. 1, 2010

(51) Int. Cl.
*B67B 1/06* (2006.01)

(52) U.S. Cl. ..... 53/317; 53/331.5; 53/318

(58) Field of Classification Search ..... 53/317, 53/331.5, 343, 490, 487, 318
See application file for complete search history.

(56) References Cited

U.S. PATENT DOCUMENTS 4,364,218 A 12/1982 Obrist
4,485,609 A * 12/1984 Kowal ..... 53/331.5
4,599,846 A 7/1986 Ellis et al.
4,674,264 A 6/1987 Ellis et al.
5,197,258 A 3/1993 Johanek
5,313,765 A 5/1994 Martin
5,437,139 A 8/1995 Martin
5,469,899 A * 11/1995 Nish ..... 141/275
5,490,369 A 2/1996 Ellis et al.
5,579,626 A * 12/1996 Thomas ..... 53/331.5
6,240,678 B1 6/2001 Spether
6,975,049 B2 * 12/2005 Ionel et al. ..... 310/49.01
7,181,892 B1 2/2007 Scott et al.
7,331,157 B2 * 2/2008 Brown ..... 53/331.5
7,343,720 B2 * 3/2008 Brown ..... 53/331.5
2008/0144185 A1 * 6/2008 Wang et al. ..... 359/665

OTHER PUBLICATIONS

Five pages of advertisement of San Diego Plastics, Inc. entitled "Rulon", undated, admitted prior art.
Three pages of advertisements by Stoffel Polygon Systems, entitled "Polygon Functional Benefits", undated, admitted prior art.

* cited by examiner

*Primary Examiner*—Sameh H. Tawfik
(74) *Attorney, Agent, or Firm*—Quarles & Brady LLP

(57) ABSTRACT

An automated capping head is disclosed. It has a linkage which permits its driven rotational sleeve to be linked to a housing such that these parts can move axially relative to one another as a cap is being tightened on a bottle. The configuration of the parts reduces wear and maintenance issues.

9 Claims, 4 Drawing Sheets

AUTOMATED CAPPING HEAD

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to equipment for threading caps onto bottles and the like. More particularly it relates to equipment which has a more wear resistant linkage in a portion of a capping head that accommodates both rotational and axial movement of a clutch of the capping head.

It is known to use automated capping equipment to apply threaded caps to pre-threaded bottles (e.g. in the beverage industry). Such equipment is typically provided with a clutch that permits enough rotational torque to cause the cap to be threaded tightly on a bottle, yet which prevents too much rotational torque from being applied (as would lead to stripping of the bottle or cap threads). See e.g. U.S. Pat. Nos. 4,364,218 and 4,599,846.

Such clutches are preferably of the hysteresis type in which two essentially ring-like arrays of magnetic material sandwich a hysteresis material between them. The relative position of one magnetic ring structure with respect to the other determines resistance to rotational torque. See e.g. U.S. Pat. Nos. 4,674,264 and 7,181,892.

In connection with such equipment the capping head is mounted on a drive shaft for rotation therewith, with the cap to be threaded on the bottle positioned at the bottom of the capping head. As the cap is threaded down onto the threads of the bottle by the capping head, there must be provision for the capping head to accommodate the axial movement of the cap while still driving the cap rotationally.

Most typically this is achieved by having a rotational drive sleeve (that is driven by the drive shaft) have mounted on it a spring. A lower housing part "floats" axially in with respect to the driven sleeve due to the spring bias. There is conventionally a linkage between the driven sleeve and lower housing to cause the driven sleeve to rotate the lower housing while also permitting this axial floating.

This linkage typically involves use of pins, splines, flats or keys acting as the linkage between the two parts. See e.g. U.S. Pat. No. 7,181,892. However, this can lead to significant wear at the linkage even if lubrication is periodically added at that point. Further, providing a means to add such lubrication periodically adds cost and requires customers to stop production lines for this maintenance (and remember to do so).

It has proven difficult to reduce the incidence of such problems without introducing still other concerns. Thus, a need still exists for improved capping heads which better address these concerns.

SUMMARY OF THE INVENTION

In one aspect the present invention provides a capping head assembly having a rotatable sleeve securable to a rotatable drive spindle, a rotatable housing positioned in a telescoping relationship with respect to the rotatable sleeve, a spring providing a force to bias the rotatable sleeve axially away from the rotatable housing, a clutch assembly linked to the rotatable housing, a cap gripper linked to the clutch assembly, and a linkage between the rotatable sleeve and the rotatable housing. Rotation of the rotatable sleeve causes rotation of the rotatable housing, while the rotatable sleeve is still able to move axially relative to the rotatable housing in response to spring pressure. The linkage is characterized by facing arcuate polygonal surfaces.

In a preferred embodiment there is a facing arcuate polygonal surface on an outer radial surface of the rotatable housing and a facing arcuate polygonal surface on either an internal radial surface of the rotatable sleeve or on an internal radial sleeve of a bushing ring positioned in the rotatable sleeve for rotation there with. Most preferably there is a facing arcuate polygonal surface on an internal radial sleeve of the bushing ring.

The facing arcuate polygonal surfaces can have cross sectional shapes such as essentially arcuate triangles, arcuate squares, arcuate pentagons, or arcuate hexagons. Arcuate square shapes are especially preferred.

The facing arcuate polygonal surfaces are preferably formed from metal or a self-lubricating material. In the latter case the use of lubricant positioned between them can be minimized or avoided.

In another preferred embodiment, the clutch assembly has a first, essentially annular, drive magnet array having a multiple pole configuration, a second, essentially annular, drive magnet array having a multiple pole configuration, and a hysteresis type essentially annular magnet interposed between the drive magnets. A bearing can also be positioned around a rotatable chuck below the magnet arrays.

Importantly, the linkage is a facing arcuate "polygonal" linkage. We use the term "facing" to mean that the arcuate surfaces face each other. We use the term "polygonal" to mean that at the linkage the cross sectional shape of the facing surfaces of both the inner telescoped member and the outer telescoped member are 70% or more radially outwardly contoured and never radially inwardly directed. Thus, they may be no more than 30% flat, and are preferably less than 10% flat. Also preferably the cross sectional shapes are essentially regular arcuate polygonal, so as to create a symmetrical design.

With reference to the magnet arrays, we are using the term "essentially annular" to refer to the final shape of the magnet or magnet array. Most typically we will use individual arc-shaped magnets which are positioned in the array to ultimately achieve the essentially annular shape.

While conventional bearing metals can be used with this design, if they are one might need to add some lubrication from time to time. Thus, we propose use of a self-lubricating material such as Rulon® TFE fluorocarbon (available from Saint-Gobain). By using Rulon it is expected that there will be no need to add a separate lubricant between the facing arcuate polygonal surfaces for most applications.

The capping heads of the present invention are suitable for standard automated capping functions. However, they achieve improvements in the areas of concern previously noted above. The preferred linkages can be manufactured at low cost, using readily available materials, and have improved wear/maintenance performance. They also create the possibility of avoiding the need for lubricants at the linkage.

These and still other advantages of the present invention will be apparent from the detailed description and drawings. What follows is merely a preferred embodiment of the present invention. To assess the full scope of the invention the claims should be looked to.

DETAILED DESCRIPTION OF THE PREFERRED EMBODIMENTS

Figure 1:
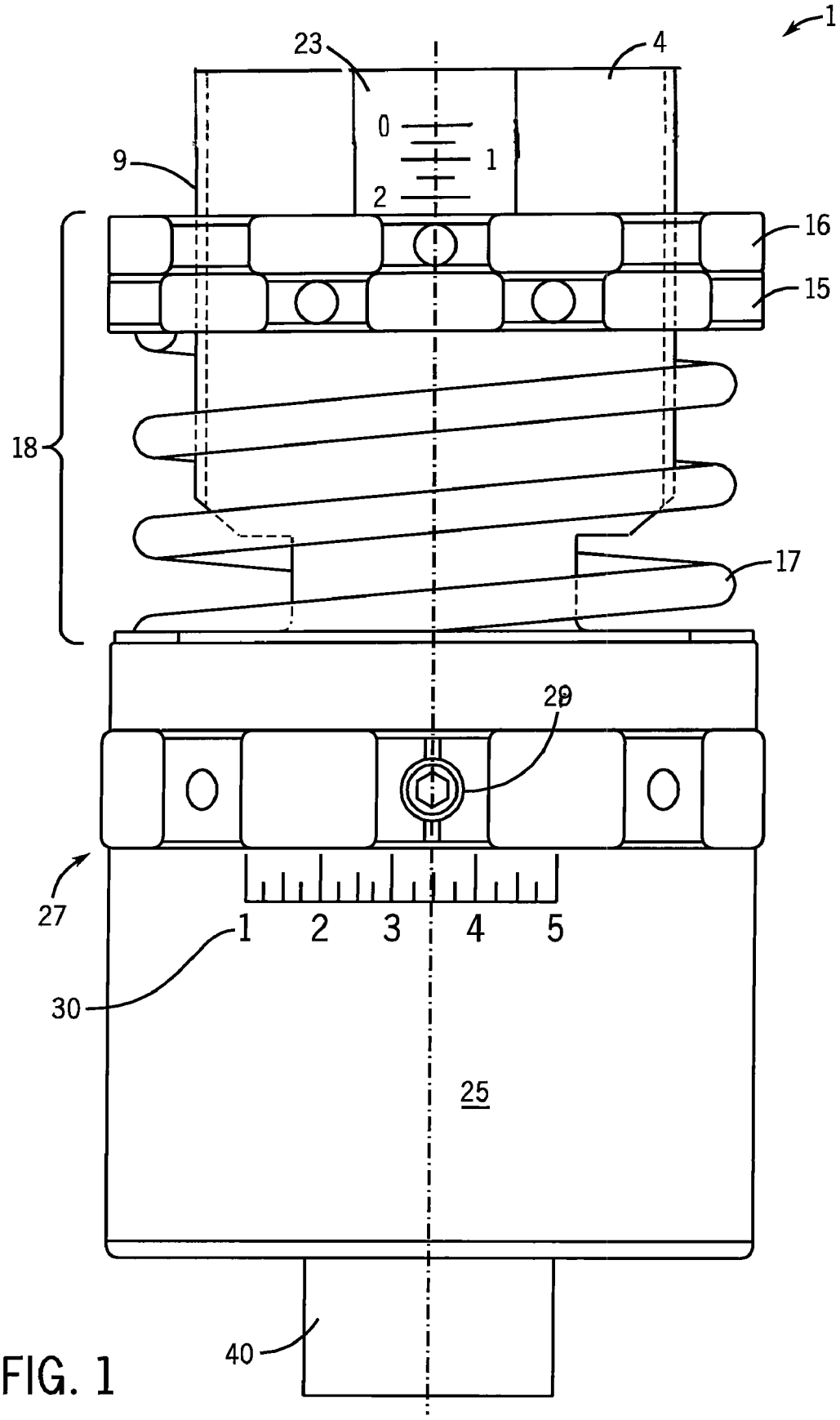
FIG. 1 is a front elevational view of a preferred capping head according to the present invention.
Figure 2:
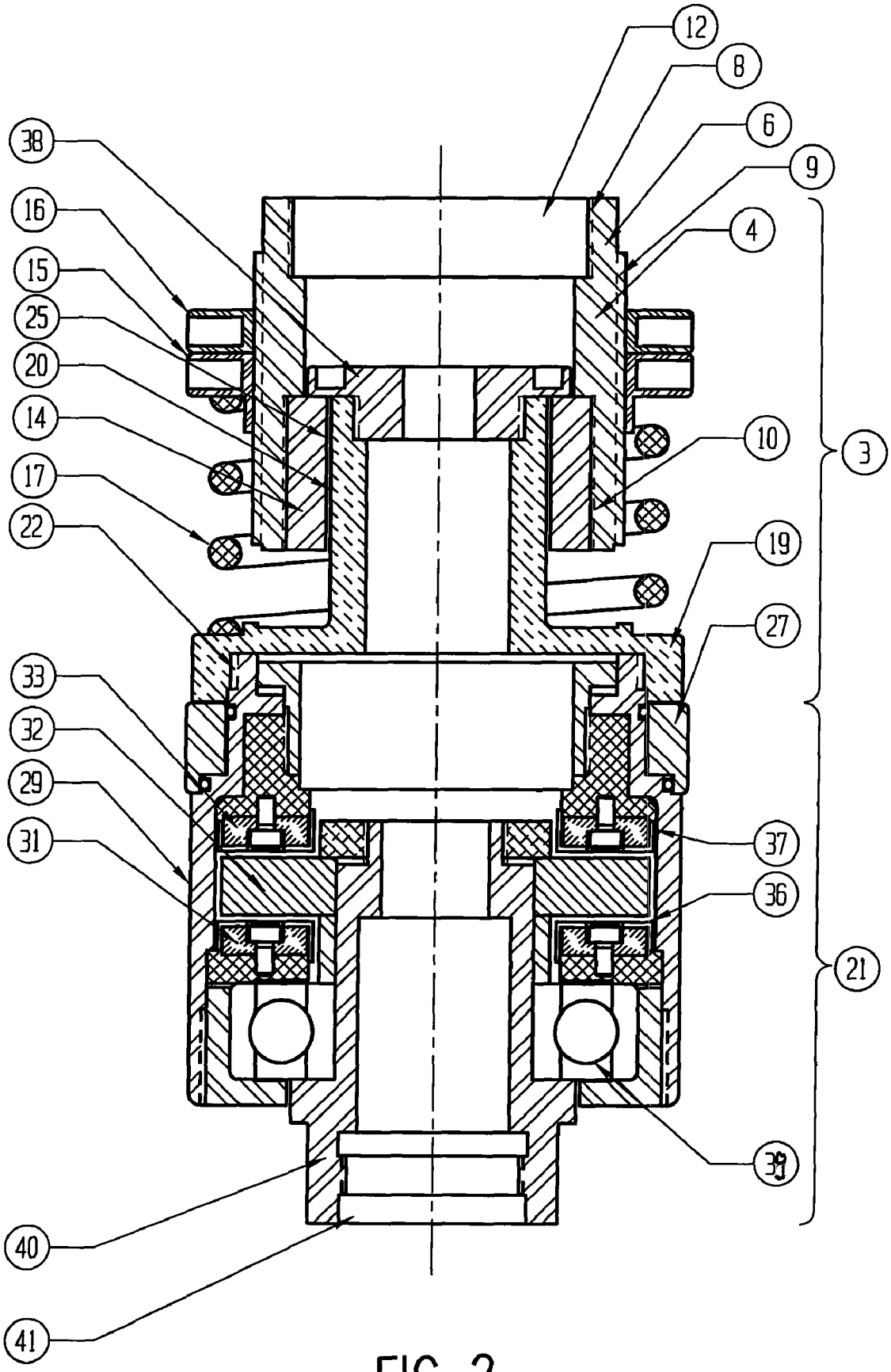
FIG. 2 is a vertical sectional view thereof.

Referring first to FIGS. 1 and 2, there is shown an automated capping head generally 1. It is attachable to a conventional rotatable drive shaft (not shown).

It should be noted that a given automated capping machine would preferably have multiple (e.g. ten) such rotatable drive shafts arrayed around a central turret. Each shaft will then have positioned on it (for rotation there with) one such automated capping head 1.

Each station of the turret will move down once, in turn, as bottles or other containers (not shown) pass underneath. The untightened caps are picked up by the cap gripper prior to the bottle or other container being positioned under the capping heads. The capping heads 1 are designed to then move downward when the bottle or other container is in the proper position, and then contact and apply downward pressure by virtue of a spring 17, and thereafter tighten the caps on the bottles to a specific torque, then slip hold that torque until they return upward so as to be in position to repeat the process with a new set of bottles and caps as they come into position.

Turning now to the specifics of the capping head, there is an upper assembly 3 that has a rotatable driven sleeve 4 having an upper portion 6, upper inner threads 8 therein, outer threads 9 thereon, and in this embodiment also lower inner threads 10. Portion 12 of the driven sleeve's through bore receives the drive shaft and links to it via upper inner threads 8.

A replaceable bushing 14 threads into the lower inner threads 10. The outer radial periphery of the bushing 14 is cylindrical, and (as is evident from FIG. 3) an inner radial facing surface 25 of the bushing 14 is essentially arcuate square.

Threaded onto the outer radial periphery of the rotatable driven sleeve 4, via the outer threads 9, are an adjustment ring 15 and jam nut 16. A compression spring 17, together with the ring 15 and jam nut 16, create an adjustable top load system 18. A lower end of the spring rests on a shoulder 19 of a rotatable housing 20.

Once the adjustment ring 15 is threaded to a desired position, the jam nut 16 threads down tightly against it to fix the adjustment ring 15 in place. This sets the axial force which works against the telescoping of the rotatable driven sleeve 4 (and associated bushing 14) with the rotatable housing 20. The rotatable driven sleeve 4 (and associated bushing 14) are restrained from being forced completely apart by spring pressure from rotatable housing 20 due to stop nut 38. The higher the ring 15 and jam nut 16 are positioned on the driven sleeve 4, the less axial force the capping head assembly will present a cap at any given position of the turret relative to the bottle and cap array.

As best shown at 23 of FIG. 1, an outer radial periphery of the rotatable driven sleeve 4 can have marked thereon indicia which allows a customer to be able to note a preferred setting of the ring 15 and jam nut 16 which achieves a particular desired performance. While this is in the form of a numerical scale in FIG. 1, other alternative indicia could be used (e.g. colors).

Figure 3:
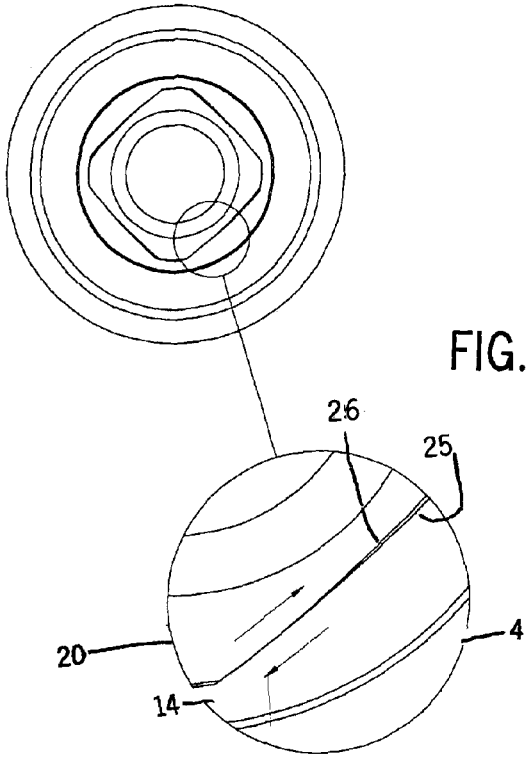
FIG. 3 is a horizontal sectional view of the FIG. 2 device, together with an additional more detailed view of a portion thereof focused on the facing surfaces.

As will be appreciated best from FIG. 3, the radial outer periphery of the top portion of the rotatable housing 20, at facing surface 26, in cross section, mates (in female/male fashion) with that of the corresponding shape of the bushing's 14 inner facing surface. By having surfaces 25/26 both gently arc outward in a symmetrical fashion for most of the circumference, forces are equalized, there is a self centering, and wear points are reduced.

Threaded onto the bottom of the rotatable housing 20, at 22, is a clutch assembly (generally 21). It has a torque adjustment ring 27 which rotates the pole positions of one magnet array 33 relative to another 31, thereby altering torque. A screw 28 fixes the torque adjustment ring 27 at a selected position, and scale 30 allows a customer to note what the position is for a particular desired performance.

Figure 4:
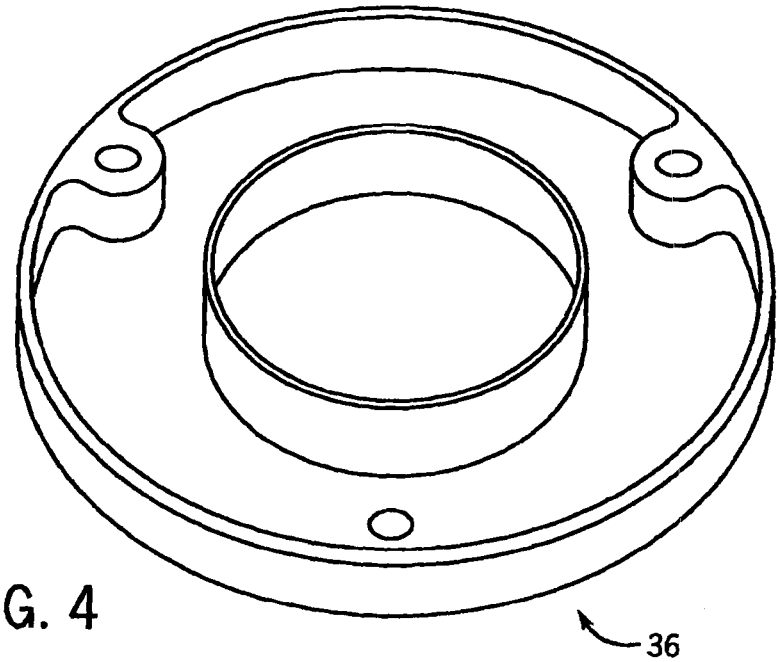
FIG. 4 is an enlarged perspective view showing a magnet keeper.
Figure 5:
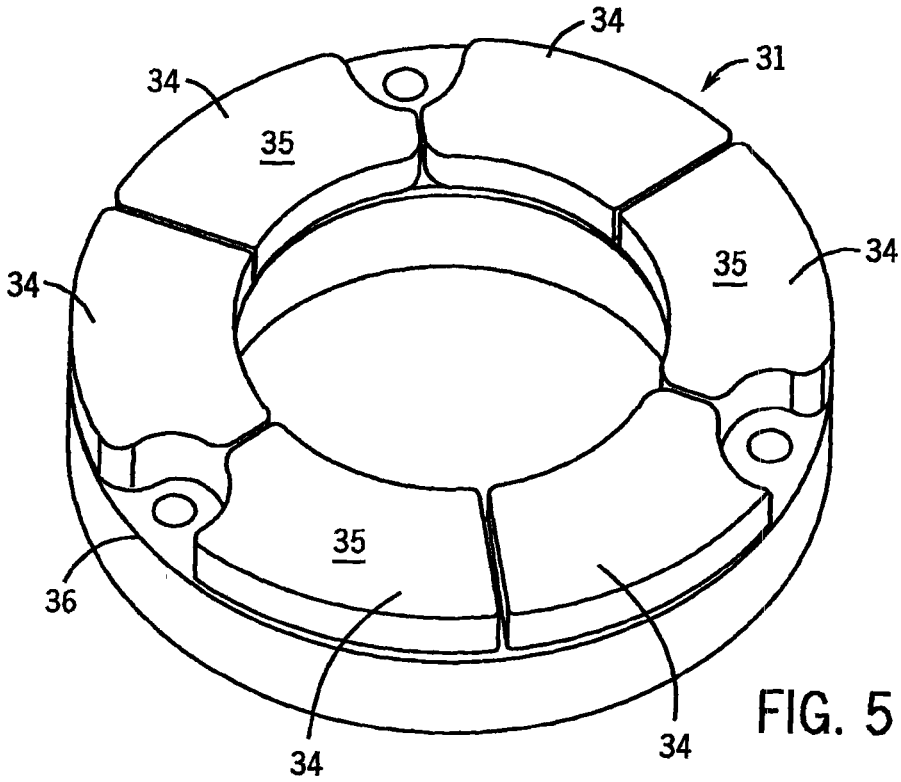
FIG. 5 is a view similar to FIG. 4, but with an array of magnets mounted therein.

The clutch assembly 21 has a first drive magnet array 31 which has a fixed rotational position relative to the clutch housing 29, and which has multiple pole configuration. As shown in FIGS. 4 and 5, this can be achieved by having six arcuate segments 34 of magnet arrayed in a ring, three of which 35 are north pole magnets, and the other three are south pole magnets.

There is also a second annular drive magnet array 33 which is rotationally adjustable and then fixable. It has similar multiple pole configurations. Movement of the torque adjustment ring 27 rotates the second annular magnet array 33 to a predetermined position.

When drive magnet array 31 has its north poles aligned with the south poles of the drive magnet array 33, magnetic flux goes through the center of the hysteresis magnet 32 that they sandwich. This is the minimum torque position. When the poles of the drive magnet arrays 31 and 33 have north and north directly opposite and aligned, the flux travels around the hysteresis magnet 32 to provide maximum torque.

When assembled the first drive magnet array 31 is most preferably positioned in a downwardly open doughnut shaped keeper 36. The second drive magnet array 33 is most preferably positioned in an upwardly open doughnut shaped keeper 37.

Bearing 39 (e.g. a ball bearing) surrounds rotatable chuck 40, which has a cap gripper attached at 41.

In operation, the drive shaft causes the rotational driven sleeve 4 to rotate along with its internal bushing 14. Yet, as the caps are being threaded down on the bottle the spring 17 applies downward pressure on the cap and bottle as the assembly moves axially downward to follow, while still keeping rotational torque at desired levels. Importantly, the facing arcuate n-polygonal (particularly arcuate square) shapes provide extremely good performance.

A preferred example embodiment of the present invention has been described in considerable detail. However, many modifications and variations of the preferred example embodiment described will be apparent to a person of ordinary skill in the art form this patent.

Figure 6:
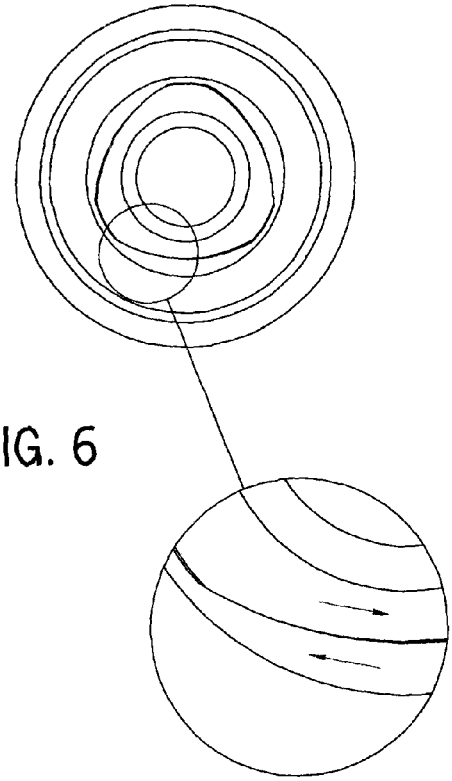
FIG. 6 is a view similar to FIG. 3, but of a second embodiment where the facing arcuate polygonal surfaces are arcuate triangular, rather than arcuate square.

For example, FIG. 6 shows a set of arcuate facing surfaces which are arcuate triangular. Also, while hysteresis magnetic clutches are preferred for use with these assemblies, it is also possible for the clutch to be of another type (e.g. mechanical, friction based, pneumatic, magnetic synchronous, hydraulic, or servo actuated).

Therefore, the invention should not be limited to the specific example embodiments described. Rather, the claims should be looked to in order to judge the full scope of the invention.

INDUSTRIAL APPLICABILITY

The invention provides improved automated capping heads.

We claim:

1. A capping head assembly, comprising:

a rotatable sleeve securable to a rotatable drive spindle, with a bushing ring mounted to the rotatable sleeve for rotation there with;

a rotatable housing positioned in a telescoping relationship with respect to the rotatable sleeve and bushing ring;

a spring providing a force to bias the rotatable sleeve axially away from the rotatable housing;

a clutch assembly linked to the rotatable housing;

a cap gripper linked to the clutch assembly; and a linkage between the rotatable sleeve and the rotatable housing whereby rotation of the rotatable sleeve causes rotation of the rotatable housing, while the rotatable sleeve is still able to move axially relative to the rotatable housing in response to spring pressure;

wherein the linkage is characterized by an arcuate polygonal surface on the bushing ring facing an arcuate polygonal surface on the rotatable housing in male/female mating fashion.

2. The capping head assembly of claim 1, wherein the facing arcuate polygonal surfaces have cross sectional shapes which are selected from the group consisting of arcuate triangles, arcuate squares, arcuate pentagons, and arcuate hexagons.

3. The capping head assembly of claim 2, wherein the facing arcuate polygonal surfaces have cross sectional shapes selected from the group consisting of arcuate squares.

4. The capping head assembly of claim 1, wherein the facing arcuate polygonal surfaces are formed from metal or a self-lubricating material.

5. The capping head assembly of claim 1, wherein there is no lubricant positioned between the facing arcuate polygonal surfaces.

6. The capping head assembly of claim 1, wherein the clutch assembly comprises:

(i) a first essentially annular drive magnet array having a multiple pole configuration;

(ii) a second essentially annular drive magnet array having a multiple pole configuration; and (iii) a hysteresis essentially annular magnet interposed between the drive magnet arrays.

7. The capping head assembly of claim 6, wherein there is a bearing positioned around a rotatable chuck below the drive magnet arrays.

8. A capping head assembly, comprising:

a rotatable sleeve securable to a rotatable drive spindle;

a rotatable housing positioned in a telescoping relationship with respect to the rotatable sleeve;

a spring providing a force to bias the rotatable sleeve axially away from the rotatable housing;

a clutch assembly linked to the rotatable housing;

a cap gripper linked to the clutch assembly; and a linkage between the rotatable sleeve and the rotatable housing whereby rotation of the rotatable sleeve causes rotation of the rotatable housing, while the rotatable sleeve is still able to move axially relative to the rotatable housing in response to spring pressure;

wherein the linkage is characterized by an arcuate polygonal surface on the rotatable sleeve facing an arcuate polygonal surface on the rotatable housing in male/female mating fashion.

9. The capping head assembly of claim 8, wherein there is an arcuate polygonal surface on an outer radial surface of the rotatable housing and a facing arcuate polygonal surface on an inner radial surface of the rotatable sleeve.

* * * * *